US006322667B1

(12) United States Patent
McCall et al.

(10) Patent No.: US 6,322,667 B1
(45) **Date of Patent: *Nov. 27, 2001**

(54) PAPER AND PAPERBOARD OF IMPROVED MECHANICAL PROPERTIES

(75) Inventors: James M. McCall, Montreal; W. J. Murray Douglas, Baie d'Urfé, both of (CA)

(73) Assignee: McGill University, Quebec (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/682,886

(22) Filed: Jul. 12, 1996

Related U.S. Application Data

(63) Continuation-in-part of application No. 08/498,471, filed on Jul. 5, 1995, now abandoned.

(30) Foreign Application Priority Data

Jul. 4, 1994 (GB) ..... 9413444

(51) Int. Cl.[7] ..... D21F 11/00; F26B 3/02

(52) U.S. Cl. ..... 162/207; 162/100; 162/147; 162/150; 34/444; 34/459

(58) Field of Search ..... 162/23, 150, 24, 162/147, 25, 26, 27, 28, 206, 207, 204, 100, 9; 34/443, 444, 448, 449, 459

(56) References Cited

U.S. PATENT DOCUMENTS

| | | | | |
|---|---|---|---|---|
| 2,760,410 | * | 8/1956 | Guillis | 162/207 X |
| 3,303,576 | | 2/1967 | Sisson | 34/115 |
| 3,432,936 | | 3/1969 | Cole et al. | 34/306 |
| 3,627,630 | * | 12/1971 | Gagnon | 162/100 |
| 4,242,808 | * | 1/1981 | Luthi | 34/23 |
| 4,294,653 | * | 10/1981 | Lindahl et al. | 162/25 |
| 4,444,622 | * | 4/1984 | Dove | 162/207 |
| 4,718,981 | * | 1/1988 | Swenson et al. | 162/206 |
| 4,836,892 | * | 6/1989 | Edwards et al. | 162/141 |
| 4,900,399 | * | 2/1990 | Bentsson et al. | 162/26 |
| 4,915,788 | * | 4/1990 | Winheim | 162/207 |
| 4,994,144 | | 2/1991 | Smith et al. | 162/111 |
| 5,105,558 | * | 4/1992 | Curry | 34/23 |
| 5,114,534 | * | 5/1992 | Rachor et al. | 162/9 |
| 5,298,118 | * | 3/1994 | Devic | 162/26 |
| 5,338,402 | * | 8/1994 | Devic et al. | 162/24 |
| 5,607,551 | * | 3/1997 | Farrington, Jr. et al. | 162/109 |

FOREIGN PATENT DOCUMENTS 86102860 4/1987 (CN) .

OTHER PUBLICATIONS

Back, E.L. "Developments in Drying Technologies," PIRA Reviews of Pulp and Paper Technology, PIRA International, Leatherhead, p. 37 (1991).

Bel'skii, A.P. Malysheva, L.V. and Moiseev, Yu.B., "Effect of Temperature During Contact Drying on Board Quality," Bumazh. Prom., 1981 (7), 25–26; Bulletin of the Institute of Paper Chemistry (ABIPC), 53(1):355.

Bel'skii, A.P. Malysheva, L.V. and Moiseev, Yu. B., "Effect of Convection Drying Parameters on the Quality of Packaging Board," Mezhvuz Sb. Nauch. Tr., Ser. Khim. Tekhnol. Bum. No. 6:83–87 (2978); Bulletin of the Institute of Paper Chemistry (ABIPC), 54(4):3725.

Bel'skii, A.P., Maysheva, L.V. and Moiseev, Yu.B., "Effect of Convection Drying Conditions on Board Quality Indices," Sb. Tr. VNIIB, Kompleksnaya Sistema Upraveniya Kachestvom Produktsii na Predpriyatiyakh Tsellyul–Bumazh Prom. (Norikov, N.E., et al., eds.), 1980, 62–64: Bulletin of the Institute of Paper Chemistry (ABIPC), 55(9):9795.

Corboy, W.G., "Yankee Dryers," Ch. 14 in Pulp and Paper Manufacture, vol. 7—Paper Machine Operations (B.A. Thorp and M.J. Kocurek, Eds.), Joint Textbook Committee of the Paper Industry of the United States and Canada, Montreal/Atlanta (1991).

Cui, W.K., Mujumdar, A.S. and Douglas, W.J.M., "Superheated Steam Drying of Paper: Effects on Physical Strength Properties," in Drying '86 (A.S. Mujumdar, Ed.), Hemisphere, New York, pp. 575–579 (1986).

David, M., Mujumdar, A.S., Crotogino, R.H. and Douglas, W.J.M., "Effect of Superheated Steam Drying on Paper Properties," in Preprints of Papers, Annual Meeting—Canadian Pulp Paper Assoc., Tech. Sect., 1988, B233–B237.

Houen, P.J. Helle, T. and Johnsen, P.O., "Effect of Recycling of Thermomechanical Pulp on Some Pulp and Handsheet Properties," in Proceedings, 18th Intnl. Mechanical Pulping Conf., 1993, 350–372.

Howard, R.C. and Bichard, W., "The Basic Effects of Recycling on Pulp Properties," J. Pulp and Paper Science, 18(4):J151–J159 (1992); J. Pulp and Paper Science 19(2):J57 (1993).

Linkletter, M.G., "Tissue Technology Advances Will Be Evolutionary," American Papermaker 52(3):28–29 (1989).

Mangin, P.J. and Dalphond, J.E., "A Novel Approach to Evaluate the Linting Propensity of Newsprint," Paprican Pulp and Paper Report 866 (1991).

Marshall, H.G., "Current Trends in Drying of Paperboard," Ch. 24 in Drying of Paper and Paperboard (G. Gavelin, Ed.), Lockwood, New York, 1972.

(List continued on next page.)

*Primary Examiner*—Jose Fortuna
(74) *Attorney, Agent, or Firm*—Birch, Stewart, Kolasch & Birch, LLP

(57) ABSTRACT

The present invention relates to an improved method of treating paper products in order to enhance various properties thereof, and more specifically, including the step of treating the paper with superheated steam. In a method of treating paper during a papermaking process from wood pulp, the step of drying the paper in superheated steam in order to improve certain physical characteristics.

11 Claims, No Drawings

OTHER PUBLICATIONS

McCall, J.M. and Douglas, W.J.M., "Superheated Steam Drying of Paper from Chemithermomechanical Pulp," Tappi, J., 77(2):153–161 (1994).

Moiseev, Yu.B., Malysheva, L.V., Kuznetsova, E.F. and Bel'skii, A.P., "Influence of Combination Drying on the Physico–Mechanical Properties of Boxboard," Sb. Tr. VNIIB, Novoe Tekhnol. Proizvod. Bumagi Kartona (Novikov, N.E., et al., eds.), 1981, 27–35; Bulletin of the Institute of Paper Chemistry (ABIPC), 56(1):476.

Nguyen, X.T., Shariff, A. and Jean, M. "Impact of Paper Recycling on the Environment and Quality of Paper and Board Products," Proc. Recycling Forum, Toronto, 1991, pp. 1–20.

Oliver, J.F., "Dry–Creping of Tissue Paper—A Review of Basic Factors." Tappi J., 63(12), 91–95 (1980).

Poirier, N.A., "The Effect of Superheated Steam Drying on the Properties of Paper," Ph.D. thesis, Department of Chemical Engineering, McGill University, 1992.

Putz, H.J., Török, I. and Göttsching, L., "Making High Quality Board from Low Quality Waste Paper," Paper Tech. & Ind., 30(6):14–20 (1989).

Sorrells, F.D., "Drying on Conventional Tissue Machines," in Tappi Notes, Tissue Runnability Seminar, TAPPI Press, pp. 281–285 (1992).

Smook, G.A., Handbook for Pulp and Paper Technologies, Joint Textbook Committee of the Paper Industry of the United States and Canada, Montreal/Atlanta p. 232 (1989).

Thompson, R., Belanger, P., Kerr, R.B. and Douglas, M.J.W., "A Superheated Steam Dryer for Tissue Paper," in Proc. Helsinki Symposium on Alternate Methods of Pulp and Paper Drying (1991), pp. 357–371.

* cited by examiner

PAPER AND PAPERBOARD OF IMPROVED MECHANICAL PROPERTIES

CROSS-REFERENCE TO RELATED APPLICATION

This application is a continuation-in-part of application Ser. No. 08/498,471, filed Jul. 5, 1995 now abandoned.

BACKGROUND OF THE INVENTION 1. Field of the Invention

The present invention relates to an improved method of treating paper products in order to enhance various properties thereof, and more specifically, including the step of treating the paper with superheated steam.

2. Description of the Prior Art

There are four broad classes of pulps produced today, namely, mechanical, chemimechanical, semichemical, and chemical pulps. Three of these, mechanical, chemical, and semichemical, are of concern to the present invention and are briefly discussed below.

Mechanical pulps such as TMP (thermo-mechanical pulp) and CTMP (chemithermomechanical pulp) are prepared by processes such as refining which convert wood chips into the pulp. Pulp yields are typically 90–95% from dry wood. Virtually all of the wood components, such as lignin, present in the wood, remain in the pulp. The term "ultra-high yield" pulps is sometimes used for these pulps.

Value can be added to mechanical pulps by additional treatments such as bleaching. For example, CTMP subjected to alkaline-peroxide treatment greatly increases the brightness and value of the pulp. BCTMP (bleached chemithermomechanical pulp) is sold on the open market for use in grades such as tissue, toweling, printing and writing papers, and paperboard.

Chemical pulps are prepared in much lower yield as a consequence of the different processing conditions. Kraft pulp is the most important example of a chemical pulp. Chips are soaked for several hours. at elevated temperature and pH in a cooking liquor which dissolves the lignin from the wood chips. These delignified chips are then thoroughly cleaned to provide a pulp consisting of long, conformable fibres.

The Kappa number is commonly used to indicate the degree is delignification of kraft pulps. It can be used with pulps having yields up to about 70%. There is essentially a linear relationship between the Kappa number and Klason lignin (i.e., acid-insoluble lignin). For these pulps, the relationship is (TAPPI Standard T236) Percent Klason lignin= Kappa number ×0.15.

Pulp yields are typically 40–55% based on dry wood for "low yield" kraft pulps. Bleaching of chemical pulps is also done to increase the brightness and commercial value. Unbleached kraft pulp is used extensively in the manufacture of linerboard, one component of containerboard.

Linerboard is typically made commercially using different kinds of pulps for different plies in the same sheet. The bottom liner is frequently made from bottom liner stock of virgin kraft pulp of about 55–60% yield, while the top liner is made from top liner stock of virgin kraft pulp of about 48–50% yield. The higher quality top liner is used to hide the lower quality basesheet and provide a better printing surface. It constitutes about 20–30% of the total linerboard weight (Smook, G. A., "Handbook for Pulp & Paper Technologists", CPPA/TAPPI, 1989).

Semichemical pulping uses a combination of chemical and mechanical treatment to develop the pulp fibres. Pulp yields vary over the wide range of 55–90% based on dry wood. NSSC (neutral sulfite semichemical) pulp typically has a yield of 75%. It is favoured for the medium, or fluting, in corrugated containers due to its high stiffness.

Recycled pulps are becoming more commonplace. OCC (old corrugated containers) pulp is used commercially to make 100% recycled linerboard. Different pulps are used to make the inner fluting and outer linerboard of a corrugated container, as noted above. OCC for linerboard manufacture can be a mixture of virgin and recycled kraft and semichemical pulps. The composition of OCC and the behavior of paper made from this furnish is further discussed.

Paper is frequently manufactured not just from pulp fibre but from a mixture of pulp fibre and inorganic particles. Such paper grades are generally referred to as "filled" papers. A variety of fillers can be used, but clay is a common example. Adding fillers to paper has a detrimental effect on the strength properties, but can improve the optical properties, of the paper.

Previous work has demonstrated that super-heated steam drying of paper made from pure mechanical pulps, such as TMP and CTMP, significantly improves the dry tensile strength of the paper without substantially increasing sheet density. Paper made from pure chemical pulps such as kraft does not have increased strength after drying in superheated steam (Cui, W.-K., Mujumdar, A. S., and Douglas, W. J. M., "Superheated Steam Drying of Paper: Effects on Physical Strength Properties," in Drying '86 [A. S. Mujumdar, Ed.], Hemisphere, N.Y., pp. 575–579 [1986]; Poirier, N. A., "The Effect of Superheated Steam Drying on the Properties of Paper," Ph.D. thesis, Department of Chemical Engineering, McGill University, 1992; McCall, J. M. and Douglas, W. J. M., "Superheated Steam Drying of Paper from Chemithermomechanical Pulp," Tappi J., 77 [2]:153–161 [1994]).

The quality requirements of a sheet of paper are becoming increasingly stringent. As paper machine speeds increase, the strength of the wet web must also be adequate to avoid web breakage. Once dried, the paper is subjected to many different end uses, depending on the grade of paper. The relative importance of the various surface and mechanical properties of the paper depends on the end use of the paper. For example, with tissue and toweling and even for some printing papers and paperboard, bulk is very important. For linerboard, the compressive strength and air resistance are two key properties. Printing and writing papers must have adequate resistance to penetration of liquids, and in some cases higher bulk is also an important property.

For many grades of paper and paperboard, a high bulk (apparent specific volume) is an important property. This is especially true for grades such as tissue and toweling for which the pulp properties and processing conditions are carefully selected to provide a final dry sheet having acceptably high bulk. A prime criterion in the choice of drying technique for these grades is the achievement of high bulk. The importance of increasing the bulk of tissue is demonstrated, for example, by the patent issued to the Kimberly Clark Corp. (U.S. Pat. No. 4,994,144, Chen et al, February 1991). Tissue and toweling frequently contain bleached chemithermomechanical pulp (BCTMP) and bleached kraft pulp (BKP) in substantial quantities.

SUMMARY OF THE INVENTION

One aim of the present invention is to provide an improved method of treating paper products in order to enhance various properties thereof, and more specifically, including the step of treating the paper with superheated steam.

Another aim of the present invention is to provide an improvement in a method of treating paper during a papermaking process from wood pulp, the step of drying the paper in superheated steam in order to improve certain physical characteristics.

In one aspect of the present invention a sheet of paper having increased bulk characteristics is provided wherein the sheet of paper is made from a pulp containing between 20% and 100% BCTMP, the pulp having a substantial lignin content, and wherein the sheet of paper has been dried by superheated steam. More specifically, the lignin content includes between 16 and 32% by weight of lignin.

The invention also relates to a method of making paper of superior bulk characteristics comprising the steps of preparing pulp with at least 20% BCTMP content and having a substantial lignin content, and drying the paper with superheated steam.

Another aspect of the present invention provides a linerboard having improved tensile, compressive strength and air resistance values made from a pulp furnish containing from 0 to 100% OCC, wherein the linerboard has been dried by superheated steam.

A method is also provided for making a linerboard sheet including preparing a furnish of 0 to 100% OCC, drying the sheet in a superheated steam environment whereby improved tensile strength, compressive strength, and air resistance values are obtained compared to a similar linerboard sheet dried in air.

A further aspect of the present invention includes a sheet of paper having an inorganic filler content with improved optical and printing properties, wherein the sheet of paper has been dried with superheated steam whereby the breaking length of the paper having 4% filler content or more does not decrease.

DESCRIPTION OF THE PREFERRED EMBODIMENTS

Use of special dryers and techniques such as through drying and use of creping or doctor blades to remove the sheet from the drying cylinder are used to impart bulk to paper dried by current technology. Dry creping of tissue has the disadvantage of reducing the tensile strength of the sheet. The development of bulk in tissue or toweling has frequently been described (Back, E. L., "Developments in Drying Technologies," Pira Reviews of Pulp and Paper Technology, Pira International, Leatherhead, p. 37 [1991]; Oliver, J. F., "Dry-Creping of Tissue Paper—A Review of Basic Factors," Tappi J., 63 [12], 91–95 [1980]; U.S. Pat. No. 4,994,144; Smith and Chen, 1991, discussed above). Patents concerning through-air drying of tissue have also been granted (U.S. Pat. No. 3,432,936, R. I. Cole, March 1969; 3,303,576, J. B. Sisson, 1967) and are used for the purpose of obtaining high bulk in the product.

The present disclosure reveals that with the specific pulps used for some paperboard and for tissue and toweling, i.e. BCTMP, including blends of BCTMP and BKP, the use of superheated steam as a drying medium can substantially increase the bulk of paper without loss of sheet strength and without the addition of any chemicals.

Key properties of linerboard are its strength and air resistance. The tensile, burst, and short-span compressive strengths, and Gurley porosity are frequently used as measures of these properties. Although the burst strength has traditionally been used as a measure of linerboard strength, the short-span (STFI) compressive strength is becoming the test of choice. Linerboard made from secondary fibres, such as from recycled old corrugated containers (OCC), are often weaker than those made from virgin fibres. As we are in a period of increasing use of recycled fibre, any technique which can regain some of the strength is potentially of even more importance commercially.

Currently linerboard manufacturers using OCC furnish may add additional expensive chemical pulp or change the pulp processing conditions in order to meet product strength specifications. Alternative methods of increasing board strength, such as through press drying, achieve the strength through densification of the sheet. Still other methods increase board strength through the addition of chemicals such as starch.

Conventional contact cylinder drying of paperboard and the effect of cylinder drying conditions on the final properties has been described (Marshall, H. G., "Current Trends in Drying of Paperboard," Ch. 24 in Drying of Paper and Paperboard [G. Gavelin, Ed.], Lockwood, N.Y., 1972; Bel'skii, A. P, Malysheva, L. V. and Moiseev, Yu. B., "Effect of Temperature During Contact Drying on Board Quality," Bumazh. Prom., 1981 [7], 25–26; Bulletin of the Institute of Paper Chemistry [ABIPC], 53[1]:355). Contact, convection, radiation, and combinations of two or all three drying methods for paperboard and the effect of drying conditions on the final properties have been compared (Bel'skii, A. P, Malysheva, L. V. and Moiseev, Yu. V., "Effect of Convection Drying Parameters on the Quality of Packaging Board," Mezhvuz. Sb. Nauch. Tr., Ser. Khim. Tekhnol. Bum. no. 6:83–87 [1978]; Bulletin of the Institute of Paper Chemistry [ABIPC], 54[4]:3725; Bel'skii, A. P., Malysheva, L. V. and Moiseev, Yu. B., "Effect of Convection Drying Conditions on Board Quality Indices," Sb. Tr. VNIIB, Kompleksnaya Sistema Upravleniya Kachestvom Produktsii na Predpriyatiyakh Tsellyul.-Bumazh. Prom. [Norikov, N. E., et al., eds.], 1980, 62–64; Bulletin of the Institute of Paper Chemistry [ABIPC], 55[9]:9795; Moiseev, Yu. B., Malysheva, L. V., Kuznetsova, E. F. and Bel'skii, A. P., "Influence of Combination Drying on the Physico-Mechanical Properties of Boxboard," Sb. Tr. VNIIB, Novoe Tekhnol. Proizvod. Bumagi Kartona [Novikov, N. E., et al., eds.], 1981, 27–35; Bulletin of the Institute of Paper Chemistry [ABIPC], 56[1]:476). The degradation of properties with recycling of furnishes used in linerboard manufacture has been described (Putz, H.-J., Török, I., and Göttsching, L., "Making High Quality Board from Low Quality Waste Paper," Paper Tech. & Ind., 30[6]:14–20 [1989]; Howard, R. C. and Bichard, W., "The Basic Effects of Recycling on Pulp Properties," J. Pulp and Paper Sci., 18[4]:J151–J159 [1992]; J. Pulp and Paper Sci., 19[2]:J57 [1993]; Nguyen, X. T., Shariff, A., and Jean, M., "Impact of Paper Recycling on the Environment and Quality of Paper and Board Products," Proc. Recycling Forum, Toronto, 1991, pp. 1–20).

The present disclosure reveals a novel way to improve the strength of linerboard without modifying the furnish composition or densifying the sheet. The technique can be applied to linerboard made from virgin kraft or made from a recycled furnish such as OCC. Specifically, the present disclosure reports that, in order to improve its strength properties, paper made from a commercial recycled linerboard furnish or from virgin kraft linerboard furnish (of about 55–67% yield) needs simply to be dried in an atmosphere of superheated steam instead of, as done universally today, dried in an atmosphere of air.

Value can be added to many grades of paper by the incorporation of inorganic particles. Such grades are commonly referred to as "filled papers". Many types of inorganic particles can be used in filled papers, one frequently used being kaolin or clay. Incorporation of inorganic particles decreases paper strength but can improve the optical properties of the sheet (Alince, B., "Optimization of Pigment Performance in Paper," in Fundamentals of Papermaking, Trans. 9th Fund. Res. Symp., Cambridge [Baker, C. F. and Punton, V. W., eds.], Mech. Eng. Publ. Ltd., London, pp. 495–508 [1989]). Papers containing mechanical pulps and fillers are included in the "groundwood specialty" grades. They are often used for newspaper inserts and catalogues, for example. These papers contain mostly mechanical pulps (60–100%) but may also contain chemical pulp (0–40%). Filler contents can be up to about 30% such as in supercalendered (SC) grades (Negele, A. R. and House, L. W., "Use of Kaolin Pigments in Uncoated Groundwood Specialties," Pulp & Paper Canada, 90[8]:60–66 [1989]). Incorporation of filler into newsprint provides a paper which is brighter, whiter, more opaque, and smoother which leads to improved printability (Koppelman, M. H. and Migliorini, I. K., "Quality Improvement in Standard Newsprint Through Filler Inclusion," in Preprints of Papers, Tappi Papermakers Conference, 1986, pp. 169–179). The use of clay filler loadings in newsprint furnishes at up to about 7% by weight can provide significant improvements in brightness and opacity, at least a 2 point increase for each property (Koppelman, M. H. and Migliorini, I. K., 1986, see above). In addition to adding value to paper, if a filler is used which is less expensive than fibre, then there is a saving associated with replacing fibre with filler.

The present disclosure teaches that paper made from a typical newsprint furnish to which a given level of clay filler is added is stronger when that sheet is dried in superheated steam rather than dried in air or as is done conventionally, in air on a hot metal surface. It furthermore teaches that the strength of filled paper dried in superheated steam does not continue to decline with increasing filler content at the rate which is found for conventional hot surface drying in air, but rather, above a certain filler content increased filler content leads to little further decrease in tensile strength.

Published work has established that the enhancement of paper properties as a result of drying the paper in superheated steam varies with broad categories of the type of pulp. For example, the earliest publication of properties of superheated steam dried paper (Cui, Mujumdar and Douglas, 1986, see above) reported significant differences in paper properties between the broad categories of paper from mechanical pulps and paper from chemical pulps.

In the enhancement of paper properties by switching to superheated steam drying, and the dependence of such enhancement on the very specific type of paper, the present report of invention takes this distinction much further than previous knowledge. For example, our reported significant enhancement in paper bulk by drying it in superheated steam is very specific to the particular pulp described above. Linerboard has traditionally been made from kraft chemical pulp. Earlier publications established that for kraft paper made from low yield kraft pulp, the switch from drying in air to drying in superheated steam does not produce strength enhancement. The linerboard we tested was made from high yield 100% virgin kraft linerboard furnish or from 100% recycled old corrugated containers (OCC), which is a blend of different chemical pulps. Additional research results are presented for linerboard furnishes made from 100% virgin kraft pulps of higher yield, specifically yields of about 55, 62, and 67%. When paper made from these pulps was dried in air in contact with a hot surface, as is done conventionally, the tensile and compressive strengths of the paper decreased with increasing yield. The opposite trend was found when paper made from these pulps was dried in superheated steam, i.e., strengths tended to increase with increasing pulp yield. The improvement in strength achieved by drying in superheated steam increased with increasing pulp yield. The significant strength enhancement that we report for this switch from drying in air to drying in superheated steam is therefore surprising and would not have been anticipated.

The wet paper webs arriving at the dryer of a paper mill come in endless variety. For paper made from virgin fibre there is the species, age, etc. of the trees, and the type and variables of the pulping, bleaching, wet end chemistry and papermaking processes used. If recycled fibre is used, there is limitless variability possible. And paper is commonly made from blends of recycled and virgin fibres. We have shown that by drying in superheated steam, some commercially important paper properties can be enhanced significantly for some very specific types of paper. Thus we claim to have discovered that one characteristic of the enhancement in paper properties resulting from the switch to drying in superheated steam is that such enhancements can be very sensitive to small changes in the type of paper. For many specific types of paper, superheated steam drying will enhance commercially important properties, while for many other specific types of paper, this drying technique will not lead to enhanced properties.

In summary, we have found that the property enhancement by superheated steam drying can be very specific to the exact type of paper.

For the research reported here, handsheets made from softwood bleached chemithermomechanical pulp, BCTMP, and blends of softwood BCTMP with softwood bleached kraft pulp, BKP, have been dried in 200° C. air and in 200° C. superheated steam. Handsheets made from hardwood BCTMP have also been dried in 150, 200, 250 and 300° C. air and in 150, 200, 250 and 300° C. superheated steam. The thickness (caliper) and other physical and optical properties of each handsheet were measured under standard paper testing conditions. Typically ten handsheets were used, with the caliper measured in five places on each handsheet, and the average of the 50 values used to calculate an average caliper. The ratio of this average caliper to the oven-dry basis weight provides the bulk ($cm^3/g$) of the sheet, also known as its apparent specific volume. Tables 1 and 3 summarize the handsheet composition, moisture content at the start of drying ($X_O$, kg water/kg fibre), and moisture content at the end of drying ($X_f$, kg water/kg fibre), and the percentage change in bulk for the various samples. Those bulks marked with an asterisk (*) in Tables 1 and 2 were dried to the indicated $X_f$ in the noted drying atmosphere (steam or air) but then removed from the drying chamber and dried in ca. 50° C. air under restraint to an $X_f$ of ca. 0.07. In all other cases, the handsheets were dried to the indicated $X_f$ solely in the indicated drying conditions. The increase in bulk, (steam-air)/air as % is indicated in the last column.

It is evident that under certain conditions, bulk of steam dried paper can be up to 25% greater than the air dried paper. Tables 2 and 4 show the measured tensile strengths expressed as breaking lengths (km) for the same samples. The increased bulk values found for the steam dried cases occur without loss of tensile strength in most cases. Previous results (McCall and Douglas, 1993, see above) with unbleached softwood CTMP handsheets showed only a small increase in bulk with superheated steam drying. Thus the effect on sheet bulk appears very specific to the pulp used, and our use of exactly the furnish used for tissue and toweling (blends of BCTMP and BKP) is important.

As this is the first study, no publications or patents exist on the effect of superheated steam drying on the bulk of papers or paperboards made from BCTMP or BCTMP/BKP blends. However, generally insignificantly small increases in bulk using superheated steam as a drying medium for paper made from types of pulp other than the above have been reported (Chinese Patent 86102860, Apr. 15, 1987, W. Cui; Cui et al., 1986; McCall and Douglas, 1993; Poirier, 1992; all discussed above. No previous study used BCTMP or BCTMP/KP blends that are used in commercial furnishes for tissue and toweling or for paperboard.

Lightweight grades of paper such as tissue and toweling are currently manufactured by a limited number of techniques. One of the most common is the drying of a paper web on a Yankee cylinder under impinging jets of air and creping the sheet on its removal from the cylinder in order to increase sheet bulk, softness and absorbency (Oliver, 1980, discussed above). Typical initial moisture content after pressing onto the Yankee cylinder is about 1.3–1.6 kg water/kg fibre (Sorrells, F. D., "Drying on Conventional Tissue Machines," in Tappi Notes, Tissue Runnability Seminar, TAPPI Press, pp. 281–285 [1992]). In the dry creping process, the sheet is removed from the Yankee cylinder using a creping or doctor blade at a moisture content of about 0.02–0.4 kg water/kg fibre (Corboy, W. G., "Yankee Dryers," Ch. 14 in Pulp and Paper Manufacture, Vol. 7—Paper Machine Operations [B. A. Thorp and M. J. Kocurek, Eds.], Joint Textbook Committee of the Paper Industry of the United States and Canada, Montreal/Atlanta [1991]). Wet creping, which is used with higher basis weight toweling rather than the lower basis weight tissue, removes the sheet at a moisture content of about 0.4–0.8 kg water/kg fibre (Corboy, 1991) with the remaining drying done on cylinder dryers.

Other techniques such as using through-dryers before or after Yankee dryers are used to preserve sheet bulk (Oliver, 1980, discussed above). Through-air drying of tissue before Yankee drying can reduce the moisture content of the web from about 4.0 to about 0.25 kg water/kg fibre (Sisson, J. B. [Procter & Gamble Company], "Apparatus for Drying Porous Paper," U.S. Pat. No. 3,303,576 [Feb. 14 1967]). Through-air drying of tissue after Yankee drying can reduce the web moisture content from about 1.5 to about 0.03 kg water/kg fibre (Cole, R. I. [Scott Paper Company], "Transpiration Drying and Embossing of Wet Paper Webs,", U.S. Pat. No. 3,432,936 [Mar. 18, 1969]). The main advantage of through-air drying for tissue is increased bulk and resultant improved softness (Back, 1991, discussed above).

All the above evidence indicates the commercial importance of high bulk for some paper grades. Improving bulk and softness without sacrificing strength have been forecast as future needs for tissue (Linkletter, 1989, discussed above).

Conversion of a conventional Yankee dryer from operating with air to operating with superheated steam has been proposed and analyzed (Thompson, R., Belanger, P., Kerr, R. B., Douglas, W. J. M., "A Superheated Steam Dryer for Tissue Paper," in Proc. Helsinki Symp. on Alternate Methods of Pulp and Paper Drying, 1991, pp. 357–371). A superheated steam dryer for printing and writing papers or paperboards could be similar to that for lightweight tissue or towel paper except that it could have more than the single cylinder sufficient for lightweight papers. A superheated steam impingement dryer for tissue or towel papers could use similar dryer hoods as used now with air, but modified to allow the use of superheated steam.

TABLE 1

| | Softwood BCTMP/BKP | | | | | | |
|---|---|---|---|---|---|---|---|
| PULP | $X_o$ | $X_f$ | $X_o$ | $X_f$ | BULK | | |
| BCTMP: BKP | STEAM-DRIED | STEAM-DRIED | AIR-DRIED | AIR-DRIED | STEAM-DRIED | AIR-DRIED | CHANGE % |
| 100:0 | 0.72 | 0.05 | 0.72 | 0.05 | 4.13 | 3.87 | 6.7 |
| 100:0 | 0.94 | 0.07 | 0.94 | 0.04 | 4.43 | 3.86 | 14.8 |
| 100:0 | 1.23 | 0.12 | 1.22 | 0.14 | 5.15* | 4.11* | 25.3 |
| 100:0 | 1.53 | 0.19 | 1.54 | 0.21 | 5.16* | 5.09* | 1.4 |
| 100:0 | 1.40 | 0 | 1.56 | 0 | 5.11 | 4.73 | 8.0 |
| 100:0 | 1.74 | 0.05 | 1.61 | 0.05 | 4.82 | 4.12 | 17.0 |
| 100:0 | 2.02 | 0.06 | 2.07 | 0.05 | 4.61 | 4.43 | 4.1 |
| 100:0 | 4.52 | 0.03 | 4.54 | 0.05 | 5.07 | 4.53 | 11.9 |
| 80:20 | 1.03 | 0.09 | 1.10 | 0.06 | 3.66 | 3.24 | 13.0 |
| 80:20 | 1.11 | 0.08 | 1.51 | 0.04 | 4.09 | 4.00 | 2.3 |
| 50:50 | 1.09 | 0.07 | 1.11 | 0.07 | 2.90 | 2.61 | 11.1 |
| 20:80 | 1.13 | 0.07 | 1.19 | 0.03 | 2.16 | 2.00 | 8.0 |

Notes to Table 1
$X_o$ = moisture content into dryer, kg water/kg oven-dry fiber
$X_f$ = moisture content out of dryer, kg water/kg oven-dry fiber
Bulk, $cm^3/g$

TABLE 2

| | Softwood BCTMP/BKP | | | |
|---|---|---|---|---|
| PULP | BULK | | BREAKING LENGTH | |
| BCTNP: BKP | STEAM-DRIED | AIR-DRIED | STEAM-DRIED | AIR-DRIED |
| 100:0 | 4.13 | 3.87 | 4.96 | 4.50 |
| 100:0 | 4.43 | 3.86 | 4.38 | 4.62 |
| 100:0 | 5.15* | 4.11* | 3.64 | 3.86 |
| 100:0 | 5.16* | 5.09* | 3.69 | 3.53 |
| 100:0 | 5.11 | 4.73 | 3.97 | 3.74 |
| 100:0 | 4.82 | 4.12 | 4.09 | 4.17 |
| 100:0 | 4.61 | 4.43 | 4.15 | 4.03 |
| 100:0 | 5.07 | 4.53 | 4.15 | 3.73 |
| 80:20 | 3.66 | 3.24 | 5.80 | 5.63 |
| 80:20 | 4.09 | 4.00 | 5.56 | 5.43 |

TABLE 2-continued

| Softwood BCTMP/BKP | | | | |
|---|---|---|---|---|
| PULP | BULK | | BREAKING LENGTH | |
| BCTNP: BKP | STEAM-DRIED | AIR-DRIED | STEAM-DRIED | AIR-DRIED |
| 50:50 | 2.90 | 2.61 | 7.95 | 7.82 |
| 20:80 | 2.16 | 2.00 | 10.02 | 10.52 |

Notes to Table 2
Bulk, $cm^3/g$
Breaking length, km

TABLE 3

| Hardwood BCTMP | | | | | | | |
|---|---|---|---|---|---|---|---|
| DRYING FLUID | $X_o$ | $X_f$ | $X_o$ | $X_f$ | BULK | | |
| TEMP ° C. | STEAM-DRIED | STEAM-DRIED | AIR-DRIED | AIR-DRIED | STEAM-DRIED | AIR-DRIED | INCREASE % |
| 150 | 0.99 | 0.12 | 1.05 | 0.04 | 2.73 | 2.42 | 12.8 |
| 200 | 1.10 | 0.03 | 1.05 | 0.09 | 2.66 | 2.57 | 3.5 |
| 250 | 1.16 | 0.11 | 0.94 | 0.02 | 2.61 | 2.47 | 8.5 |
| 300 | 1.24 | 0.05 | 0.98 | 0.07 | 2.63 | 2.50 | 5.2 |

Notes to Table 3
$X_o$ = moisture content into dryer, kg water/kg oven-dry fiber
$X_f$ = moisture content out of dryer, kg water/kg oven-dry fiber
Bulk, $cm^3/g$

TABLE 4

| Hardwood BCTMP | | | | |
|---|---|---|---|---|
| DRYING FLUID | BULK | | BREAKING LENGTH | |
| TEMP. ° C. | STEAM-DRIED | AIR-DRIED | STEAM DRIED | AIR-DRIED |
| 150 | 2.73 | 2.42 | 4.53 | 4.30 |
| 200 | 2.66 | 2.57 | 4.58 | 4.38 |
| 250 | 2.68 | 2.47 | 4.65 | 4.50 |
| 300 | 2.63 | 2.50 | 4.63 | 4.44 |

Notes to Table 4
Bulk, $cm^3/g$
Breaking length, km

There are few documented reports of the effect of recycling on the properties of paper made from a commercial furnish derived from OCC. One approach being used in German mills (Putz et al., 1989, discussed above) improves the properties of paper when a low quality recycle furnish was used to manufacture test liner (the term given to linerboard made from OCC) and corrugating medium. They separated the poor quality furnish into its long and short fibre fractions, then refined the long fibre component, and blended it back with the short fibre fraction. The individual fractions can also be used in other applications.

Koning, J. W. and Godshall, W. D., "Repeated Recycling of Corrugated Containers and Its Effect on Strength Properties," Tappi J., 58(9):146–150 (1975), prepared linerboard from virgin southern pine unbleached kraft pulp and corrugating medium from virgin mixed hardwood neutral sulfite semichemical (NSSC) pulp on a pilot paper machine. Double-face corrugated board was made from these components. The board was then reslushed and linerboard was made from the recycled corrugated board, i.e., from an OCC furnish. The properties of the linerboard made from the virgin fibre were compared with the properties of the linerboard made from the OCC pulp. The linerboard made from 100% OCC was 22% weaker in ring crush, and about 25% weaker in tensile strength.

In laboratory studies of unbleached beaten kraft, the main component by weight of an OCC furnish (Howard and Bichard, 1992, discussed above), demonstrated that after 5 recycles there was a 7% reduction in density, 17% reduction in breaking length, 21% reduction in burst index, and 67% reduction in air resistance.

Corrugated containers are composite structures made from corrugating medium (fluting) between linerboard factors. Semichemical pulp is the furnish of choice for the manufacture of the corrugated medium. Corrugating medium made from 100% OCC is referred to as "bogus" medium and is of low quality. To qualify as "semichemical corrugating medium," the recycled fibre content must be less than 50%. When compared at the same bulk or density, corrugating medium made with recycled fibres is always weaker than that made from virgin pulps. Equal or improved strength or stiffness of the recycle medium has been achieved only through densification (Nguyen et al., 1991, discussed above).

Laboratory recycling of paper made from 100% thermomechanical pulp (TMP) leads to increased density and tensile strength (Houen, P. J., Helle, T., and Johnsen, P. O., "Effect of Recycling of Thermomechanical Pulp on Some Pulp and Handsheet Properties," in Proceedings, 18th Intnl. Mechanical Pulping Conf., 1993, 350–372). However, this is due to the generation of fines during the recycling process which leads to sheet densification and thereby higher tensile strengths.

OCC furnish is an example of a pulp mixture. For OCC furnishes, the relative amounts of the components (e.g. kraft pulp for linerboard and semichemical pulp for fluting) are ill-defined because of variable fibre supply, a consequence of the nature of the recycling process. In general, tensile strengths of chemical and mechanical pulps are not linearly additive for the tensile strengths of blends of the components. Both positive and negative deviations from nonlinearity have been reported for chemical-mechanical pulp mixtures (Smook, G. A., "The Role of Chemical Pulp in Newsprint Manufacture," Pulp & Paper Canada, 80(4):82–87 [1979]; Retulainen, E., "Strength Properties of Mechanical and Chemical Pulp Blends," Paperi Ja Puu, 74(5):419–426 [1992]).

For the research results reported here, handsheets made from a commercial linerboard furnish consisting of 100% recycled OCC (old corrugated containers) have been dried with complete restraint, under multiple impinging jets, in air and in superheated steam. Basis weights (g/m$^2$), initial ($X_o$) and final ($X_f$) moisture contents (kg water/kg fibre) and drying conditions (drying time in seconds, jet temperature in °C., jet Reynolds Number) are shown in Table 5. Physical properties are summarized in Table 6. For the 205 g/m$^2$ sheets, significant improvements in product quality are reflected in the large increases seen in several properties of the steam dried sheets relative to the air dried sheets, namely STFI compression strength (7%), breaking length (13%), toughness (TEA index, 7%), elastic modulus (19%), zero-span breaking length (21%), and Gurley air resistance (41%). These increases in strengths were accomplished not only without densification of the sheet, but actually with a 4% increase in bulk.

Optical properties (Table 7, brightness, opacity, L*, a*, b*) are reported for the impingement side (wire side) of the sheet. The differences in optical properties between linerboard dried in air and in superheated steam are small and, for linerboard, are generally of no commercial importance. For additional research results reported here, handsheets made from three linerboard furnishes of different yields, but each consisting of 100% virgin kraft pulp, have been dried with complete restraint in a flow of superheated steam at 200° C. passing parallel to the surfaces of the sheet, and dried in air by contact with a hot surface maintained at 150° C. Basis weights (g/m$^2$), initial ($X_o$), and final ($X_f$) moisture contents (kg water/kg fibre) and drying conditions (superheated steam or hot surface temperature in ° C.) are shown in Table 8. Physical properties are summarized in Table 9. For the 205 g/m$^2$ sheets, significant improvements in product quality are reflected in the large increases seen in several properties of the steam dried sheets relative to the air dried sheets, namely STFI compression strength (9–15%), tensile index (1–18%), tensile stiffness index (39–51%), and Gurley resistance (3–42%).

Optical properties (Table 10, brightness, opacity, L*, a*, b*) are reported for the wire side of the sheet. The difference in optical properties between linerboard dried in air and in superheated steam are small and, for linerboard, are generally of no commercial importance.

Handsheets were also made from a commercial thermo-mechanical pulp (TMP) containing 3.4% of recycled, deinked pulp. These were dried under complete restraint in a flow of air or superheated steam. Basis weights (g/m$^2$), initial ($X_o$) and final ($X_f$) moisture contents (kg water/kg fibre) and drying conditions (drying time in seconds, jet temperature in ° C.) are shown in Table 11. Physical properties are summarized in Table 12. Large increases are seen in several properties of the steam dried sheets relative to the air dried sheets, namely STFI compressive index (37%), breaking length (23%), toughness (TEA index, 27%), and specific elastic modulus (7%). These increases in strengths were accomplished without a significant change in the density of the sheet, i.e. without the densification used by some other techniques of strength enhancement.

Optical properties (Table 13, brightness, opacity, L*, a*, b*) are reported for the wire side of the sheet. The differences in optical properties between these high basis weight samples dried in air and in superheated steam are, for linerboard application, of generally no commercial importance.

The publications which cite improvements of properties of other grades of paper using superheated steam as a drying medium (Cui et al., 1986; McCall and Douglas, 1993; Poirier, 1992; discussed above) have not used the furnish we used and have not dried linerboard.

One patent exists on the effect of superheated steam drying on properties of linerboard, but without the finding of improvement in the key property of paperboard strength (Cui, W., "Superheated Steam Drying Methods and Dryers for Paper and Paperboard," assigned to Zhao, M. and Yu, H., Chinese Patent 86102860 [Apr. 15, 1987]).

Recent, confidential research in the laboratory of Prof. Douglas at McGill University on rates of drying linerboard by impinging jets of superheated steam establish that linerboard can be dried by impinging jets of superheated steam. Thus linerboard could be dried commercially by superheated steam impingement using a modification of the industrial Yankee dryer design currently providing air impingement drying of lightweight grades such as tissue paper and toweling. For heavy basis weight grades such as linerboard, more than the single Yankee cylinder used currently for drying tissue and toweling paper could be required.

Heavy weight grades of paper such as linerboard are currently dried by contact heat transfer in passing over many steam heated cylinders in an atmosphere of air. Use of drying under impinging jets, sometimes referred to as high velocity air caps, can augment such cylinder drying (Marshall, 1972, discussed above). A superheated steam dryer for heavy basis weights could use hoods with high velocity superheated steam jets in place of hoods of impinging air jets in conjunction with cylinder drying. Conversion of a Yankee dryer from use with air to use with superheated steam has been described (Thompson et al., 1991, discussed above).

TABLE 5

DRYING CONDITIONS
Impingement Drying

| BASIS WEIGHT | DRYING MEDIUM | $X_o$ | $X_f$ | DRYING TIME | $T_j$ | $Re_j$ |
|---|---|---|---|---|---|---|
| 207 | air | 1.00 | 0.06 | 50 | 250 | 3000 |
| 217 | steam | 1.01 | 0.05 | 40–43 | 250 | 4700 |

Notes to Table 5
$X_o$ = moisture content into dryer, kg water/kg oven-dry fiber
$X_f$ = moisture content out of dryer, kg water/kg oven-dry fiber
Drying time, seconds
$T_j$ = jet temperature, ° C.
$Re_j$ = jet Reynolds Number

TABLE 6

PHYSICAL PROPERTIES
Impingement Drying

| | | NOMINAL 205 g/m$^2$ | | |
|---|---|---|---|---|
| TEST | UNITS | AIR | STEAM | CHANGE % |
| Basis Weight | g/m$^2$ | 206.7 | 217.2 | |
| Caliper | μm | 487 | 532 | 9.2 |
| Sp. Vol. | cm$^3$/g | 2.36 | 2.45 | 3.8 |
| Burst Index | kpa · m$^2$/g | 2.62 | 2.68 | 2.3 |
| Breaking Length | km | 3.60 | 4.08 | 13.3 |
| Stretch | % | 2.29 | 2.20 | −3.9 |
| TEA Index | mJ/g | 584 | 626 | 7.2 |
| Specific | km | 357 | 425 | 19.0 |

TABLE 6-continued

| PHYSICAL PROPERTIES Impingement Drying | | | | |
|---|---|---|---|---|
| | | NOMINAL 205 g/m² | | |
| TEST | UNITS | AIR | STEAM | CHANGE % |
| Elastic Modulus | | | | |
| STFI Comp. Str. | kN/m | 5.01 | 5.35 | 6.8 |
| Z-Span Breaking Length | km | 7.12 | 8.60 | 20.8 |
| Scott Bond | J/m² | 148 | 133 | −10.1 |
| Gurley Air Res. | s/100 mL | 10.9 | 15.4 | 41.2 |

TABLE 7

| OPTICAL PROPERTIES Impingement Drying | | | |
|---|---|---|---|
| | | NOMINAL 205 g/m² | |
| TEST | UNITS | AIR | STEAM |
| Basis Weight | g/m² | 206.7 | 217.2 |
| Brightness (ISO) | % | 18.5 | 17.7 |
| Opacity (ISO) | % | 100 | 100 |
| L* | | 61.0 | 59.8 |
| a* | | 3.7 | 3.6 |
| b* | | 18.9 | 18.6 |

TABLE 11

| DRYING CONDITIONS Parallel-Flow Drying | | | | | |
|---|---|---|---|---|---|
| BASIS WEIGHT | DRYING MEDIUM | $X_o$ | $X_f$ | DRYING TIME | $T_j$ |
| 146 | air | 1.17 | 0.06 | 48 | 200 |
| 136 | steam | 0.94 | 0.05 | 53 | 200 |

Notes to Table 11
$X_o$ = moisture content into dryer, kg water/kg oven-dry fibre
$X_f$ = moisture content out of dryer, kg water/kg oven-dry fibre
Drying time, seconds
$T_j$ = jet temperature, ° C.
$Re_j$ = jet Reynolds Number

TABLE 12

| PHYSICAL PROPERTIES Parallel-Flow Drying | | | | |
|---|---|---|---|---|
| TEST | UNITS | AIR | STEAM | CHANGE % |
| Basis Weight | g/m² | 146 | 136 | |
| Caliper | μm | 419 | 384 | −8.4 |
| Sp. Vol. | cm³/g | 2.87 | 2.83 | −1.4 |
| Burst Index | kPa · m²/g | 2.27 | 2.38 | 4.8 |
| Breaking Length | km | 4.50 | 5.54 | 23.1 |

TABLE 12-continued

| PHYSICAL PROPERTIES Parallel-Flow Drying | | | | |
|---|---|---|---|---|
| TEST | UNITS | AIR | STEAM | CHANGE % |
| Stretch | % | 2.1 | 2.2 | 4.8 |
| TEA Index | mJ/g | 526 | 668 | 27.0 |
| Specific Elastic Modulus | km | 283 | 304 | 7.4 |
| STFI Comp. Ind. | Nm/g | 22.9 | 31.4 | 37.1 |

TABLE 13

| OPTICAL PROPERTIES Parallel-Flow Drying | | | |
|---|---|---|---|
| TEST | UNITS | AIR | STEAM |
| Basis Weight | g/m² | 146 | 136 |
| Brightness (ISO) | % | 56.7 | 52.3 |
| Opacity (ISO) | % | 100.0 | 100.0 |
| L* | | 86.4 | 84.6 |
| a* | | −0.2 | 0.0 |
| b* | | 12.0 | 13.3 |

For the work described here, nominally 60 g/m² handsheets were prepared from a commercial unbleached TMP containing 3.4% of recycled (deinked) pulp and a commercial clay filler. The filler was incorporated into the handsheets using a commercial retention aid. Control handsheets made in the same manner but without clay filler addition were also prepared. Ashing was done in duplicate at 920° C. for 4 hours and is expressed as weight percent of oven-dry furnish (i.e., filler+fibre). Table 14 summarizes the handsheet composition, moisture content at the start of drying ($X_o$, kg water/kg furnish), and moisture content at the end of drying ($X_f$, kg water/kg furnish). Three drying conditions were used: (1) drying under complete restraint in the plane of the sheet in a flow of superheated steam at 200° C. passing parallel to the surfaces of the sheet, (2) drying similarly except using air at 200° C. as the drying medium, and (3) drying under restraint with the sheet dried by contact with a metal surface maintained at 150° C. The thickness (caliper) and other physical and optical properties of each handsheet were measured under standard paper testing conditions. Typically ten handsheets were used, with the caliper measured in five places on each handsheet, and the average of the 50 values used to calculate an average caliper. The ratio of the oven-dry basis weight to this average caliper provides the apparent density (g/cm³) of the sheet.

Physical properties are summarized in Table 15. As more filler is incorporated in the paper, the strength of the sheet decreases for all of the drying conditions used. The burst index, tensile index, and tensile breaking length show this trend. Toughness, as measured by TEA (tensile energy absorption) Index, and specific elastic modulus are also higher for the steam dried papers. The sheets dried in superheated steam are stronger than the paper dried in air or on the hot surface.

Significantly, the strengths of the steam dried sheets do not further decrease after about 5% filler content, whereas the strengths of the hot surface dried or the air dried sheets continue to decline. Thus, at any particular filler content, not only is paper dried in superheated steam stronger, but the percent improvement in strength over paper dried in air or on the hot surface increases with increasing filler content (Table 16). Thus it appears that the higher the filler content and the lower the strength of the paper dried conventionally in air, the greater is the relative improvement in strength produced by drying in superheated steam.

Optical properties are summarized in Table 17. Increasing the filler content of paper improves the optical (e.g., opacity and brightness) and printing properties, but sharply and steadily decreases the strength (e.g., burst and tensile) properties, of filled papers dried in a conventional manner on cylinder dryers (Negele and House, 1989; Koppelman and Migliorini, 1986; Alince, 1989; all discussed above). The present work shows that filler addition also increases the brightness and opacity of paper dried in superheated steam. However, the breaking length of superheated steam dried paper does not decrease above about 4% filler content, and the brightness and opacity do continue to increase, therefore additional filler can be added to substantially improve the optical properties of the paper without degrading the strength properties as compared to paper dried conventionally by contact with a hot surface.

As this is the first study, no publications or patents exist on the effect of superheated steam drying on the properties of papers containing inorganic particles such as mineral fillers. Publications which cite improvements of properties of other grades of paper using superheated steam as a drying medium have used only pure pulps (Cui et al, 1986; McCall and Douglas, 1993; Poirier, 1992; all discussed above).

Filled papers used in printing and writing are currently dried by contact heat transfer in passing over many steam heated cylinders in an atmosphere of air. However, hygienic papers such as tissue and toweling frequently use recycled pulp from fine papers which contain large amounts of fillers. Thus, it is possible that even these grades contain small amounts of filler. These lightweight grades are currently manufactured by a limited number of techniques. One of the most common is the drying of a paper web on a Yankee cylinder under impinging jets of air and creping the sheet on its removal from the cylinder. Other techniques such as through-drying before or after Yankee drying are also used (Sisson, 1967; Oliver, 1980; discussed above).

Conversion of a conventional Yankee dryer from operating with air to operating with superheated steam has been proposed and analyzed (Thompson et al, 1991, discussed above). A superheated steam dryer for printing and writing papers could be similar to that for lightweight tissue or towel paper except that it could have more than the single cylinder sufficient for lightweight papers. A superheated steam impingement dryer for tissue or towel papers could use similar dryer hoods as used now with air, but modified to allow the use of superheated steam.

While the invention has been described with particular reference to the illustrated embodiment, it will be understood that numerous modifications thereto will appear to those skilled in the art. Accordingly, the above description should be taken as illustrative of the invention and not in a limiting sense.

TABLE 8

DRYING CONDITIONS
Parallel-Flow Drying

| PULP | KAPPA NUMBER | BASIS WEIGHT | DRYING MEDIUM | $X_o$ | $X_f$ | T |
|---|---|---|---|---|---|---|
| A | 97.5 | 206.0 | air-contact | 1.69 | 0.06 | 150 |
| | 97.5 | 204.6 | steam | 1.52 | 0.07 | 200 |
| B | 130.5 | 210.2 | air-contact | 1.52 | 0.04 | 200 |
| | 130.5 | 200.0 | steam | 1.46 | 0.05 | 150 |
| C | 150 | 208.7 | air-contact | 1.49 | 0.05 | 200 |
| | 150 | 200.0 | steam | 1.58 | 0.05 | 150 |

Notes to Table 8

$X_o$ = moisture content into dryer, kg water/kg oven-dry fibre $X_f$ = moisture content out of dryer, kg water/kg oven-dry fibre T = temperature of hot surface for air-contact drying, jet temperature for drying in superheated steam, ° C.

TABLE 9

PHYSICAL PROPERTIES
Parallel-Flow Drying

| PROPERTY | UNITS | DRYING CONDITION | PULP A | PULP B | PULP C |
|---|---|---|---|---|---|
| Yield (screened) | (%) | | 55.39 | 62.44 | 67.21 |
| Kappa Number | | | 97.5 | 130.5 | 150.0 |
| Est. Klason Lignin | % | | 14.6 | 19.6 | 22.5 |
| Basis Weight (o.d.) | $g/m^2$ | air-contact | 206.0 | 210.2 | 208.7 |
| | | steam | 204.6 | 200.0 | 200.0 |
| Tensile Index | Nm/g | air-contact[1] | 53.0 | 50.7 | 49.1 |
| | | steam | 53.6 | 60.0 | 54.5 |
| | | % change | 1 | 18 | 11 |
| Ten. Stiff. Index | MNm/kg | air-contact[1] | 3.29 | 3.50 | 3.33 |
| | | steam | 4.97 | 4.85 | 4.76 |
| | | % change | 51 | 39 | 43 |
| STFI Compr. Index | Nm/g | air-contact | 25.7 | 25.5 | 24.9 |
| | | steam | 27.9 | 29.3 | 28.0 |
| | | % change | 9 | 15 | 12 |
| Gurley Air Resis. | s/100 $cm^3$ | air-contact | 16.20 | 27.37 | 13.92 |
| | | steam | 9.43 | 25.93 | 14.38 |
| | | % change | 42 | 5 | 3 |

Note to Table 9

[1]Basis weights used for pulps A, B, and C were 210.8, 207.9, and 206.2 $g/m^2$, respectively.

TABLE 10

OPTICAL PROPERTIES
Parallel-Flow Drying

| PROPERTY | UNITS | DRYING CONDITION | PULP A | PULP B | PULP C |
|---|---|---|---|---|---|
| Yield (screened) | % | | 55.39 | 62.44 | 67.21 |
| Kappa Number | | | 97.5 | 130.5 | 150 |
| Est. Klason Lignin | % | | 14.6 | 19.6 | 22.5 |
| Basis Weight (o.d.) | $g/m^2$ | air-contact | 206.0 | 210.2 | 208.7 |
| | | steam | 204.6 | 200.0 | 200.0 |
| Brightness (ISO) | % | air-contact | 15.4 | 16.4 | 17.9 |
| | | steam | 15.4 | 15.6 | 16.4 |
| Opacity | % | air-contact | 99.9 | 99.8 | 99.9 |
| | | steam | 99.8 | 99.9 | 100.0 |
| L* | | air-contact | 57.9 | 60.1 | 62.3 |
| | | steam | 58.7 | 59.7 | 61.3 |

TABLE 10-continued

| OPTICAL PROPERTIES Parallel-Flow Drying | | | | | |
|---|---|---|---|---|---|
| | | DRYING | PULP | | |
| PROPERTY | UNITS | CONDITION | A | B | C |
| a* | | air-contact | 5.8 | 5.8 | 5.5 |
| | | steam | 5.2 | 5.3 | 5.3 |
| b* | | air-contact | 20.8 | 22.5 | 22.8 |
| | | steam | 22.3 | 23.4 | 24.5 |

TABLE 14

| DRYING CONDITIONS | | | | |
|---|---|---|---|---|
| ASH CONTENT (%) | FILLER CONTENT (%) | DRYING MEDIUM | $X_o$ | $X_f$ |
| 0.41 | 0.00 | air | 1.94 | 0.06 |
| 0.38 | 0.00 | steam | 1.38 | 0.05 |
| 0.53 | 0.00 | contact | 1.67 | 0.01 |
| 3.19 | 2.78 | air | 1.55 | 0.04 |
| 3.31 | 2.93 | steam | 1.47 | 0.07 |
| 3.13 | 2.60 | contact | 1.50 | 0.08 |
| 5.61 | 5.20 | air | 1.28 | 0.05 |
| 5.96 | 5.58 | Steam | 1.33 | 0.10 |
| 6.11 | 5.58 | contact | 1.49 | 0.06 |
| 8.96 | 8.55 | air | 1.40 | 0.03 |
| 8.46 | 8.08 | steam | 1.41 | 0.08 |
| 9.93 | 9.40 | contact | 1.34 | 0.02 |

Notes to Table 14
$X_o$ = moisture content into dryer, kg water/kg oven-dry fibre
$X_f$ = moisture content out of dryer, kg water/kg oven-dry fibre

TABLE 15

| PHYSICAL PROPERTIES | | | | | | |
|---|---|---|---|---|---|---|
| TEST | UNITS | | | | | |
| Filler Content | % | Air | 0.00 | 2.78 | 5.20 | 8.55 |
| | | Steam | 0.00 | 2.93 | 5.58 | 8.08 |
| | | Contact | 0.00 | 2.60 | 5.58 | 9.40 |
| Ash Content | % | Air | 0.41 | 3.19 | 5.61 | 8.96 |
| | | Steam | 0.38 | 3.31 | 5.96 | 8.46 |
| | | Contact | 0.53 | 3.13 | 6.11 | 9.93 |
| Basis Weight | $g/m^2$ | Air | 56.35 | 57.33 | 58.58 | 58.69 |
| | | Steam | 56.46 | 58.88 | 58.70 | 57.82 |
| | | Contact | 58.20 | 58.23 | 58.98 | 57.59 |
| Caliper | $\mu m$ | Air | 201 | 199 | 193 | 188 |
| | | Steam | 202 | 209 | 201 | 196 |
| | | Contact | 203 | 198 | 206 | 196 |
| App. Density | $g/cm^3$ | Air | 0.281 | 0.288 | 0.303 | 0.312 |
| | | Steam | 0.280 | 0.282 | 0.292 | 0.296 |
| | | Contact | 0.287 | 0.295 | 0.287 | 0.294 |
| Burst Index | $kPa \cdot m^2/g$ | Air | 2.43 | 2.08 | 2.12 | 1.87 |
| | | Steam | 2.76 | 2.41 | 2.33 | 2.35 |
| | | Contact | 2.52 | 2.30 | 2.04 | 1.88 |
| Breaking Length | km | Air | 5.05 | 4.54 | 4.21 | 4.13 |
| | | Steam | 5.54 | 5.10 | 4.98 | 5.03 |
| | | Contact | 4.91 | 4.57 | 4.08 | 3.80 |
| Stretch | % | Air | 1.97 | 1.70 | 1.83 | 1.78 |
| | | Steam | 1.71 | 2.07 | 2.07 | 1.88 |
| | | Contact | 2.00 | 1.81 | 1.80 | 1.78 |
| TEA Index | ml/g | Air | 599 | 457 | 464 | 442 |
| | | Steam | 625 | 652 | 623 | 569 |
| | | Contact | 590 | 487 | 440 | 415 |
| Specific Elastic Modulus | km | Air | 416 | 410 | 356 | 357 |
| | | Steam | 453 | 414 | 395 | 424 |
| | | Contact | 423 | 402 | 345 | 320 |

TABLE 15-continued

| PHYSICAL PROPERTIES | | | | | | |
|---|---|---|---|---|---|---|
| TEST | UNITS | | | | | |
| Tensile Index | Nm/g | Air | 49.51 | 44.45 | 41.20 | 40.51 |
| | | Steam | 54.25 | 49.98 | 48.80 | 49.25 |
| | | Contact | 48.13 | 44.74 | 39.99 | 37.21 |

TABLE 16

| STRENGTH IMPROVEMENT | | | | | |
|---|---|---|---|---|---|
| Filler Content (%) | Contact | 0.00 | 2.60 | 5.58 | 9.40 |
| | Steam | 0.00 | 2.93 | 5.58 | 8.08 |
| Breaking Length (km) | Contact | 4.91 | 4.57 | 4.08 | 3.80 |
| | Steam | 5.54 | 5.10 | 4.98 | 5.03 |
| Change in Breaking Length (%) | (Steam-Contact)/Contact | 13 | 12 | 22 | 32 |

TABLE 17

| OPTICAL PROPERTIES | | | | | | |
|---|---|---|---|---|---|---|
| TEST | UNITS | | | | | |
| Filler Content | % | Air | 0.00 | 2.78 | 5.20 | 8.55 |
| | | Steam | 0.00 | 2.93 | 5.58 | 8.08 |
| | | Contact | 0.00 | 2.60 | 5.58 | 9.40 |
| Ash Content | % | Air | 0.41 | 3.19 | 5.61 | 8.96 |
| | | Steam | 0.38 | 3.31 | 5.96 | 9.46 |
| | | Contact | 0.53 | 3.13 | 6.11 | 9.93 |
| Basis Weight | $g/m^2$ | Air | 56.35 | 57.33 | 58.58 | 58.69 |
| | | Steam | 56.46 | 58.88 | 58.70 | 57.82 |
| | | Contact | 58.20 | 58.23 | 58.98 | 57.59 |
| Brightness (ISO) | % | Air | 53.9 | 57.4 | 59.3 | 60.9 |
| | | Steam | 51.3 | 54.3 | 57.1 | 58.1 |
| | | Contact | 55.4 | 57.4 | 59.5 | 61.3 |
| Opacity (ISO) | % | Air | 97.1 | 97.4 | 97.8 | 98.1 |
| | | Steam | 96.1 | 97.2 | 97.6 | 97.6 |
| | | Contact | 96.3 | 96.7 | 97.3 | 97.8 |
| L* | | Air | 85.5 | 86.9 | 87.7 | 88.2 |
| | | Steam | 84.4 | 85.7 | 86.7 | 87.1 |
| | | Contact | 86.4 | 87.0 | 87.8 | 88.5 |
| a* | | Air | −0.1 | −0.2 | −0.2 | −0.3 |
| | | Steam | 0.0 | −0.1 | −0.1 | −0.1 |
| | | Contact | −0.2 | −0.2 | −0.3 | −0.3 |
| b* | | Air | 13.2 | 12.0 | 11.4 | 10.9 |
| | | Steam | 13.9 | 13.1 | 11.9 | 11.6 |
| | | Contact | 13.2 | 12.2 | 11.5 | 11.0 |

We claim:

1. A sheet of paper wherein the paper is made from a pulp containing between 20% and 100% bleached chemithermomechanical pulp (BCTMP), which has a lignin content of between 16% and 32%, and wherein the sheet of paper has been dried by superheated steam, whereby the sheet of paper has increased strength and increased bulk characteristics of 5% to 25% compared to a sheet of paper made from the same furnish but dried in air.

2. The sheet of paper as defined in claim 1, wherein the average increase in bulk expressed in percentages is greater than 10%.

3. A linerboard made from a furnish containing essentially old corrugated containers (OCC) pulp, wherein the linerboard has been dried by superheated steam, thereby providing improved tensile strength, compressive strength and air resistance at least by about 5% compared to a linerboard sheet made from the same furnish but dried in air.

4. A linerboard as defined in claim 3, wherein the linerboard furnish consists of 100% recycled OCC and for a sheet of about 212 g/m$^2$ dried with superheated steam compared to an air-dried sheet of similar basis weight, there is a compressive strength improvement of 7%, a breaking length improvement of 13%, and an air resistance improvement of 41%.

5. A linerboard as defined in claim 3, wherein the linerboard furnish consists of 100% recycled OCC and for a sheet of about 141 g/m$^2$ dried with superheated steam compared to an air-dried sheet of similar basis weight, there is a compressive strength improvement of 37% and a breaking length improvement of 23%.

6. A sheet of paper having an inorganic filler content at least about 2% to about 9%, wherein the strength of the sheet which has been dried in superheated steam is greater by at least about 10% compared to the strength of a sheet of paper made from the same furnish and dried in air wherein the density of the sheet is between about 180 kg/m$^3$ and about 312 kg/m$^3$.

7. A linerboard made from a high yield kraft pulp having a lignin content defined by the Kappa number from about 97.5 to 150 and wherein the linerboard has been dried in superheated steam, whereby the sheet has improved tensile index in the range 1% to 18%, improved tensile stiffness index in the range 39% to 51%, improved STFI compression index in the range 9% to 15%, and improved Gurley air resistance in the range 3% to 42%, compared to a sheet made from the same furnish but dried in air.

8. The linerboard as defined in claim 7, wherein the weight of a sample of the linerboard is between about 200.0 g/m$^2$to 210.2 g/m$^2$.

9. A method of making paper of superior bulk characteristics comprising the steps of preparing a pulp with at least 20% bleached chemithermomechanical pulp (BCTMP) content and having a lignin content of between 16% and 32%, and drying with superheated steam the paper made from such pulp to provide a paper having increased strength and increased bulk characteristics of 5% to 25% compared to a sheet of paper made from the same furnish and moisture content dried by air.

10. The method as defined in claim 9, wherein the pulp is dried to a moisture content of 0 to 0.19 kg water/kg oven-dry fibre by superheated steam.

11. A method of making a linerboard sheet including preparing a furnish containing essentially old corrugated containers (OCC) pulp and drying the sheet in a superheated steam environment whereby improved tensile strength, compressive strength and air resistance values of at least 5% are obtained compared to a linerboard sheet made from the same furnish but dried in air.

* * * * *